US005402723A

United States Patent [19]

Friedrichs et al.

[11] Patent Number: 5,402,723

[45] Date of Patent: Apr. 4, 1995

[54] DEVICE FOR SHEET-FORMAT ADJUSTMENT OF A SHEET-TRANSFER DRUM

[75] Inventors: Jens Friedrichs, Heidelberg; Rudi Haupenthal, Epfenbach, both of Germany

[73] Assignee: Heidelberger Druckmaschinen AG, Heidelberg, Germany

[21] Appl. No.: 240,930

[22] Filed: May 10, 1994

[30] Foreign Application Priority Data

May 10, 1993 [DE] Germany ..... 43 15 514.6
May 10, 1993 [DE] Germany ..... 43 15 528.6

[51] Int. Cl.[6] ..... B41F 1/28

[52] U.S. Cl. ..... 101/415.1; 271/277; 101/378

[58] Field of Search ..... 101/415.1, 382.1, 378; 271/277

[56] References Cited

U.S. PATENT DOCUMENTS 3,625,150 12/1971 Wurzburg et al. ..... 101/415.1
4,083,303 4/1978 McInerny ..... 101/415.1
4,476,783 10/1984 Tsukaski et al. ..... 101/415.1
5,026,045 6/1991 Wirz et al. ..... 271/277
5,172,634 12/1992 Iwamoto .

FOREIGN PATENT DOCUMENTS 0011076 5/1980 European Pat. Off. .
0089080 9/1983 European Pat. Off. .
1571935 4/1977 United Kingdom .
2181415 4/1987 United Kingdom .

*Primary Examiner*—Eugene H. Eickholt
*Attorney, Agent, or Firm*—Herbert L. Lerner; Laurence A. Greenberg

[57] ABSTRACT

Device for sheet-format adjustment of a sheet-transfer drum, formed of sheet-holding elements displaceable in guides in a rotational direction of the sheet-transfer drum and having at least two gripper devices for holding sheet leading and trailing edges, the gripper devices being adjustable relative to one another in an outer cylindrical surface of the sheet-transfer drum in the rotational direction thereof, the sheet-holding elements and the gripper devices being simultaneously adjustable for sheets to be transported on the sheet-transfer drum, includes resilient elements connected to adjacent sheet-holding elements on both sides of the sheet-transfer drum, the resilient elements having substantially identical spring constants.

8 Claims, 8 Drawing Sheets

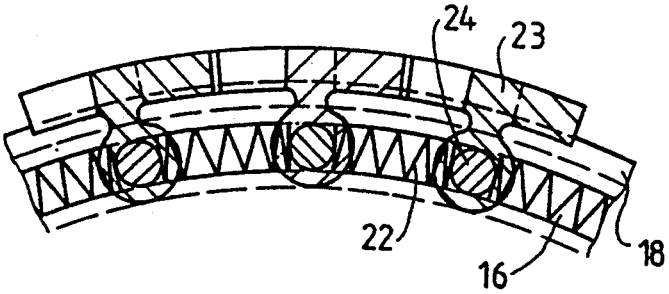
Fig. 2
Fig. 3
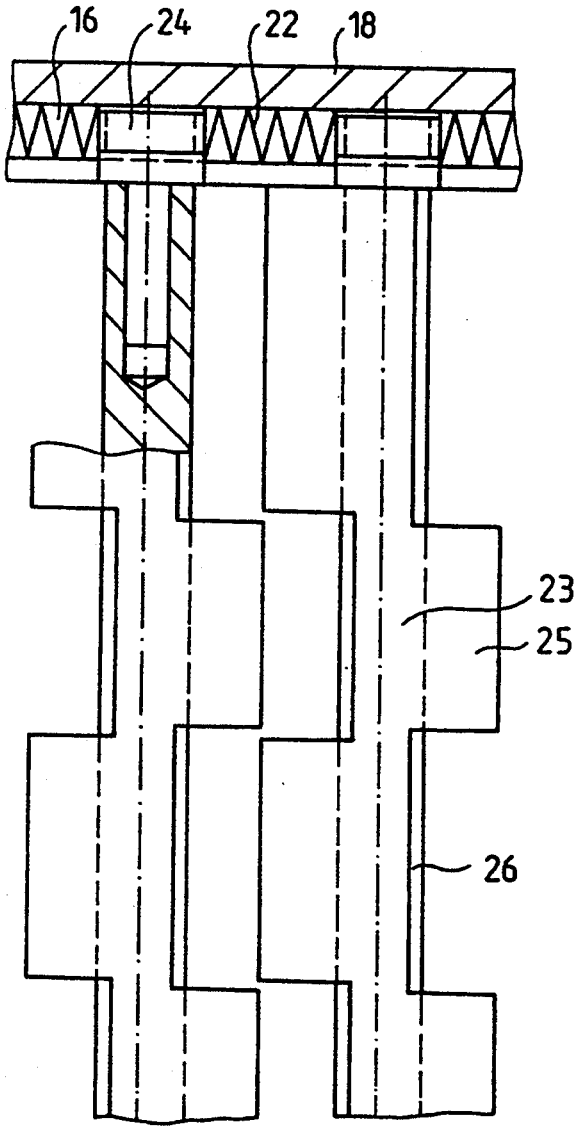
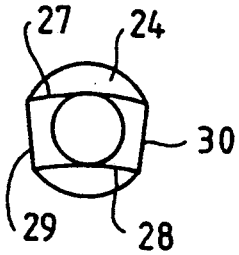
Fig. 4

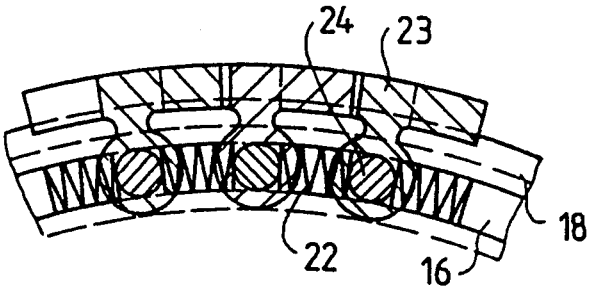
Fig. 5
Fig. 6
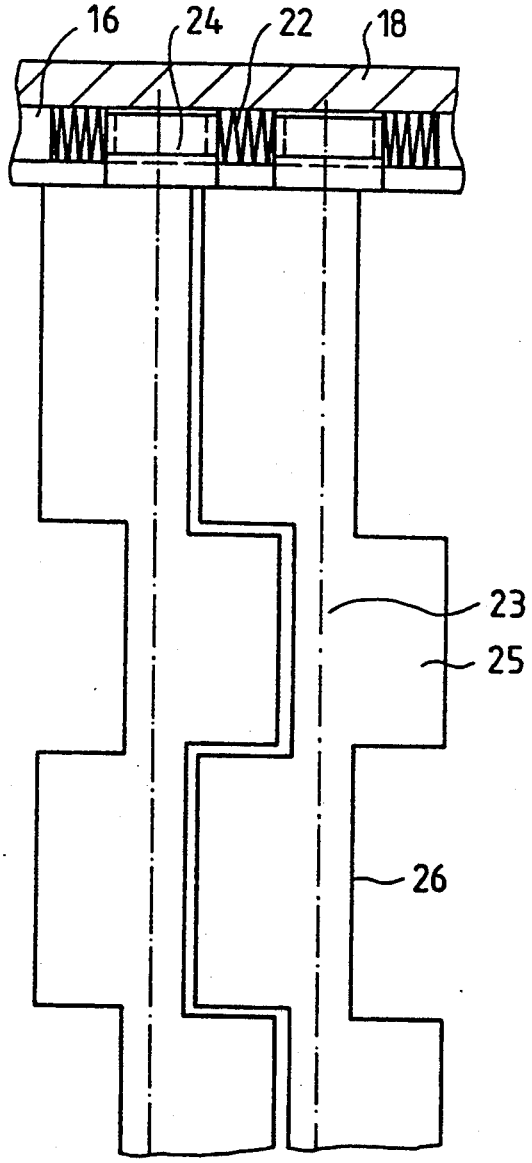

Fig. 13a
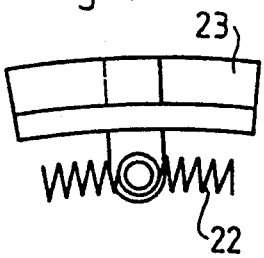
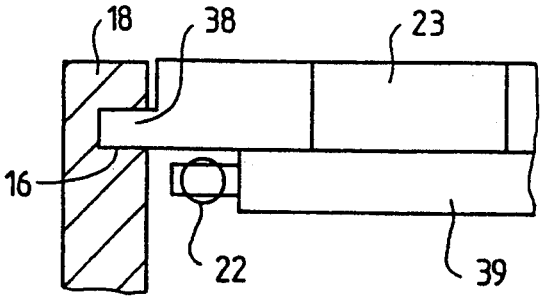
Fig.13
Fig. 14a
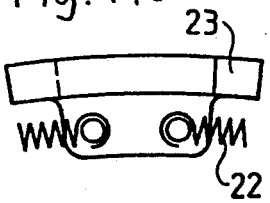
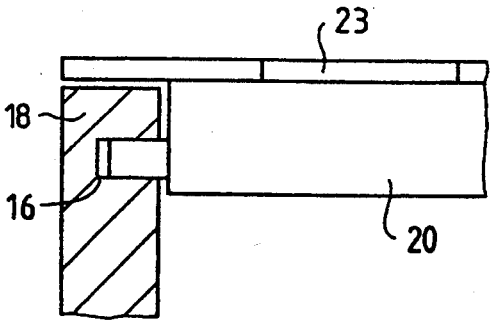
Fig.14
Fig.15
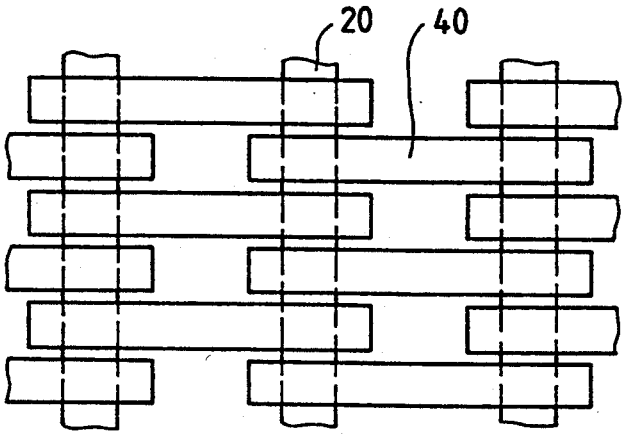
Fig.16
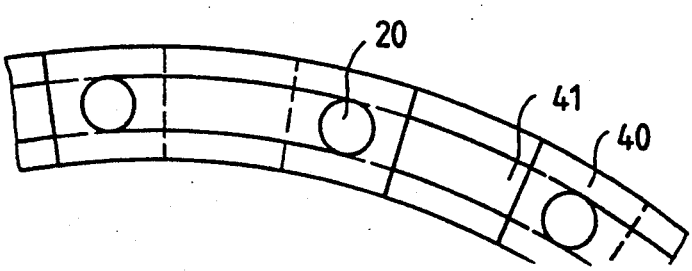

DEVICE FOR SHEET-FORMAT ADJUSTMENT OF A SHEET-TRANSFER DRUM

The invention relates to a device for sheet-format or size adjustment of a sheet-transfer drum and, more particularly, to such a device which is usable in sheet-fed rotary printing presses wherein sheet-transfer drums are provided for conveying sheets, the gripper position and sheet-holding surfaces of the sheet-transfer drums having to be set to a new sheet size or format whenever there is a job change.

Published German Patent Document DE 35 35 621 Cl describes a sheet-transfer drum with such a device. The sheet-transfer drum serves to transport two sheets, which are held at their leading edge in grippers and at their trailing edge by means of suction-type grippers on the outer cylindrical surface of the sheet-transfer drum. The sheet-holding surface is formed by outer cylindrical-surface segments which, together with the suction-type grippers, are disposed on a common receiver. For setting to a new sheet size or format, the receiver is of flexible construction and is insertable into a guide channel, the guide channel having, in the drum-rotation direction, an outer section as well as an inner section. Through partial insertion of the receiver into the inner section, the sheet-holding surface can be continuously or steplessly reduced in the rotational direction of the sheet-transfer drum to match the sheet size or format which is to be printed. A disadvantage of this construction is that, for setting to a new sheet size or format, the outer cylindrical-surface elements must cover a relatively large rotational-angle range, and that, on their path into the inner section, the outer cylindrical-surface segments pass a connecting channel having a narrow radius and causing a reversal of the direction of motion between the motion of the outlying and the innerlying outer cylindrical-surface segments. This lengthens the time required for a change-over operation as well as the associated downtime of a printing press. The guiding of the outer cylindrical-surface segments from outside to inside requires an elaborate construction due to the reversal of the motion direction in the interior of the sheet-transfer drum. Setting to a new sheet size or format can be performed manually or automatically, for which purpose position-measuring devices and remotely controllable motorized drive systems may be provided (German Utility Patent 83 19 431 and published German Patent Document 31 36 349 Al).

In a different embodiment of this heretofore known device, tail wheels are provided as sheet-holding elements, the tail wheels being seated on guide rods. Prior to the displacement of the outer cylindrical-surface segments into the inner section, the guide rods and/or tail wheels can be removed in order to ensure unimpeded displacement. The manual removal of the tail wheels is time-consuming, which lengthens the change-over time to a different sheet size or format.

Further devices for sheet-size or format adjustment have become known heretofore, the devices containing two sheet-holding segments interlocking in the direction of rotation, the sheet-holding segments being rotatable in relation to one another about a common shaft (Japanese Patents 4-153039 and 4-158804).

A disadvantage of these constructions is that the sheet-holding segments forming the sheet-holding surface form slots or edges transverse to the rotation direction of the sheet-transfer drum, the slots or edges possibly adversely affecting the printing quality whenever the sheets lie, with their printed side down, on the outer cylindrical surface of the sheet-transfer drum.

Published European Patent Document EP 0 165 477 Al describes a covering for a sheet-transfer drum, the covering embodying an outer cylindrical surface on which one printed side of the sheet can be transported unharmed. In a different embodiment thereof, for changing over to a new sheet size or format, a storage drum has, in the region of the trailing sheet edges, a suction box adjustable in the rotation direction. A disadvantage is that the adjustment range between a maximum and a minimum sheet size or format is small for design-inherent reasons.

There is described in German Utility Patent DE GM 91 15 526, a cylinder for a printing press having an outer cylindrical surface broken down into ring zone-shaped or matrix-shaped sub-elements independently retractable, by remote control, in the radial spacing thereof. The sub-elements may be retracted by mechanical, electrodynamic, pneumatic or hydraulic driving means, the driving means exclusively permitting radial motion of the sub-elements.

This construction has the disadvantage that a multiplicity of actuating elements is required, the actuating elements being material and cost-intensive. Furthermore, no sheet-size or format adjustment is provided for the gripper devices holding the sheet leading and trailing edges.

It is accordingly an object of the invention to provide a device for sheet-size or format adjustment of a sheet-transfer drum, the device permitting, by relatively simple means, a rapid changeover to a new sheet size or format, while the number of sheet-supporting sheet-holding elements remains the same.

With the foregoing and other objects in view, there is provided, in accordance with the invention, a device for sheet-format adjustment of a sheet-transfer drum, formed of sheet-holding elements displaceable in guides in a rotational direction of the sheet-transfer drum and having at least two gripper devices for holding sheet leading and trailing edges, the gripper devices being adjustable relative to one another in an outer cylindrical surface of the sheet-transfer drum in the rotational direction thereof, the sheet-holding elements and the gripper devices being simultaneously adjustable for sheets to be transported on the sheet-transfer drum, comprising resilient elements connected to adjacent sheet-holding elements on both sides of the sheet-transfer drum, the resilient elements having substantially identical spring constants.

In accordance with another feature of the invention, the resilient elements are tension springs.

In accordance with a first alternative feature of the invention, the resilient elements are compression springs.

In accordance with a second alternative feature of the invention, the resilient elements are shaped rubber elements.

In accordance with a third alternative feature of the invention, the resilient elements are rubber cords, and the guides for the sheet-holding elements are embedded in the rubber cords.

In accordance with a fourth alternative feature of the invention, the resilient elements are rubber rings, respectively, looping around two adjacent guides of the sheet-holding elements.

In accordance with another aspect of the invention, there is provided a device for sheet-format adjustment of a sheet-transfer drum, including sheet-holding elements displaceable in guides radially and in a rotational direction of the sheet-transfer drum, gripper devices for holding sheet leading and trailing edges, the gripper devices being adjustable in an outer cylindrical surface of the sheet-transfer drum in a rotational direction thereof, the sheet-holding elements and the gripper devices being simultaneously adjustable for sheets to be transported, comprising orbital guideways disposed laterally of the sheet-transfer drum, guide rods running in the orbital guideways, other rods disposed between the guide rods and being radially displaceable, all of the guide rods adjacent one another and the other rods being rigidly connected to one another, and the sheet-holding elements being disposed on the guide rods and the other rods.

In accordance with a concomitant feature of the invention, the device includes a plurality of bars mounted on the guide rods and cooperatively engaging at least two mutually adjacent ones of the guide rods and the other rods extending in one direction, coupling elements extending between the guide rods and the other rods, and pins disposed in the guide rods and in the coupling elements for rigidly connecting the guide rods and the other rods.

Thus, an object of the invention is achieved in that the sheet-holding elements of a sheet-transfer drum are disposed on connected guide rods, every second one of which runs in an orbital guideway, and in that the guide rods lying therebetween are radially movable.

An object of the invention is also achieved in that the sheet-holding elements, displaceable in guides in the rotational direction of a sheet-transfer drum, are connected to resilient or spring-loaded elements, the resilient elements having substantially a like spring constant.

In a particular embodiment, the coupling elements between the guide rods are specially formed and are provided with pins which, in cooperation with bars, which may likewise be provided with pins, cause a defined moving-in of every second guide rod. In this embodiment, the radially movable guide rods are not pulled in simultaneously, but are moved radially inwardly one after the other starting from one side, so that, with reference to the sheet surface for each sheet size or format, there are the same number of support points. In order to set the sheet-holding elements to a new sheet size or format, they are pushed together or pulled apart against the force of the spring elements in the outer cylindrical-surface plane of the sheet-transfer drum and are then fixed in position. Such displacement may be effected manually or under remote control by motor. In any case, the number of sheet-holding elements remains the same. The sheet-holding elements may be provided with an ink-repellent surface or layer. The sheet-holding elements may be of such construction that they provide as closed an outer cylindrical surface as possible in the sheet-holding plane.

Tension or compression springs may be used as the spring elements. In further constructions, the spring elements may be provided in the form of individual specially shaped rubber elements or rubber cords, wherein the sheet-holding elements or auxiliary guiding elements are embedded. Likewise, it is possible for rubber rings to be provided as the spring elements between two adjacent sheet-holding elements, the rubber rings each looping in pairs around a sheet-holding element or the auxiliary guiding element thereof.

Other features which are considered as characteristic for the invention are set forth in the appended claims.

Although the invention is illustrated and described herein as embodied in a device for sheet-format adjustment of a sheet-transfer drum, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 2 is an enlarged fragmentary view of FIG. 1 showing the sheet-transfer drum with a closed outer cylindrical surface;

FIG. 3 is a top plan view of FIG. 2 showing the sheet-transfer drum in a position for a maximum sheet size or format;

FIG. 4 is a head end view of a specially formed guide pin shown in longitudinal view in FIG. 3;

FIGS. 5 and 6 are views similar to those of FIGS. 2 and 3, respectively, showing sheet-holding elements in a position for a minimum sheet size or format;

FIGS. 13 and 13*a* are fragmentary views taken in planes perpendicular to one another of a different embodiment of the device according to the invention for guiding the sheet-holding elements;

FIGS. 14 and 14*a* are fragmentary views similar to those of

Figure 17:
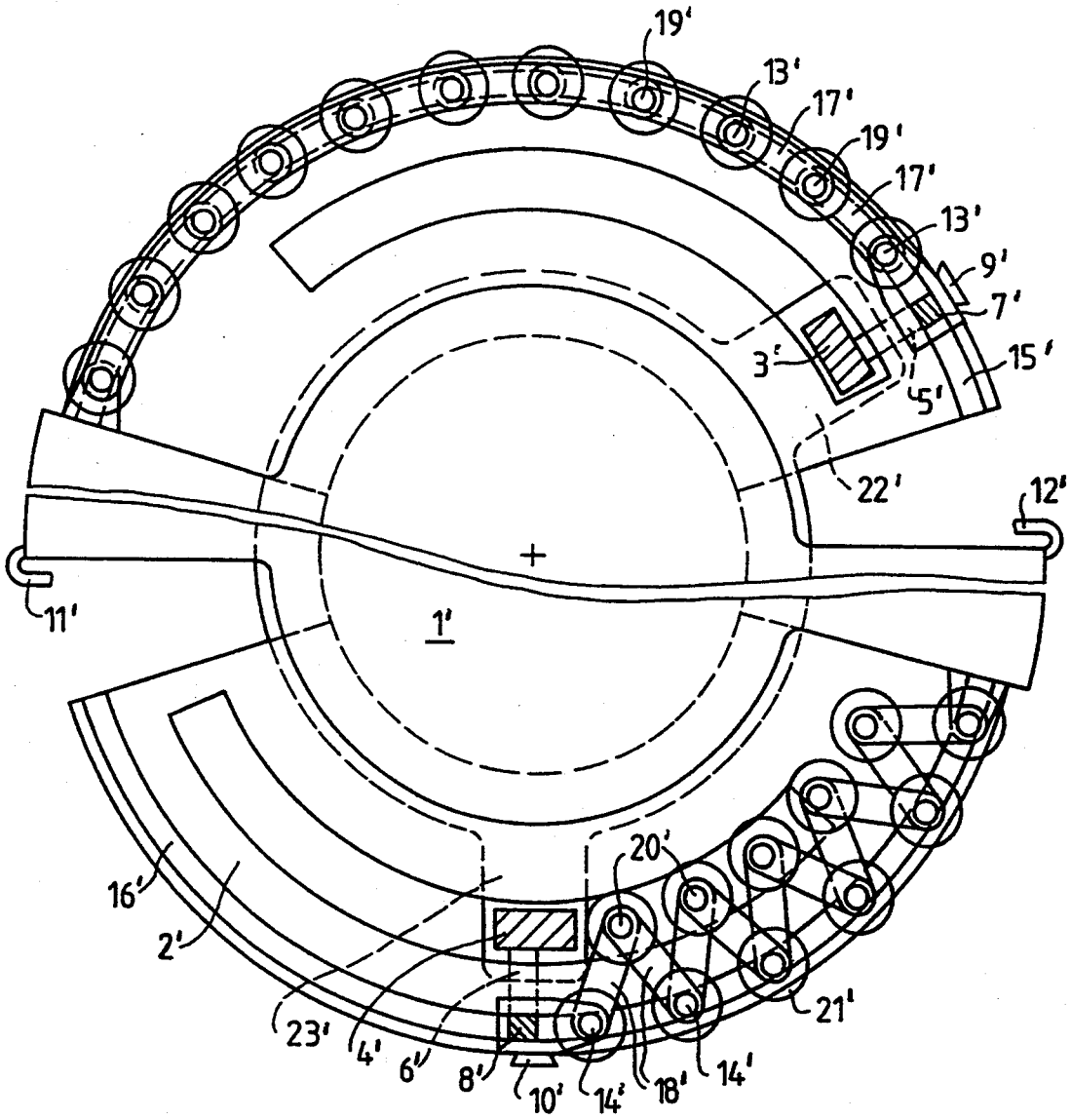
Figure 18:
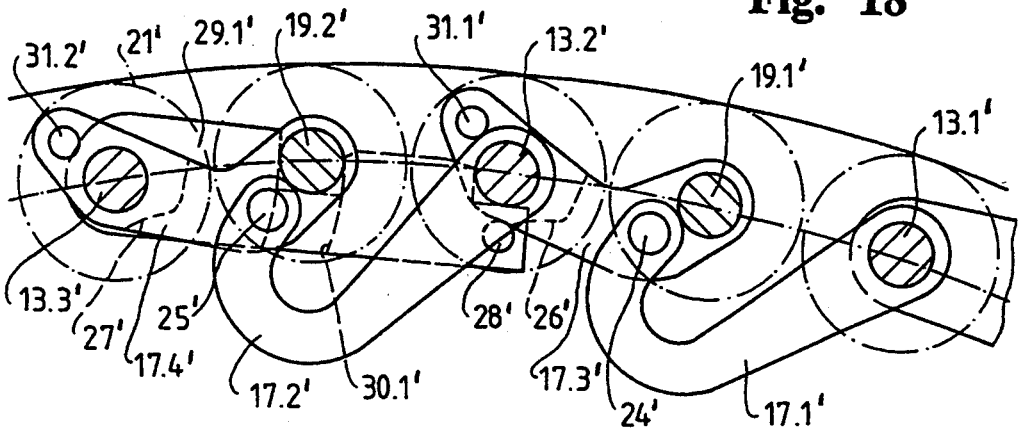
Figure 18A:
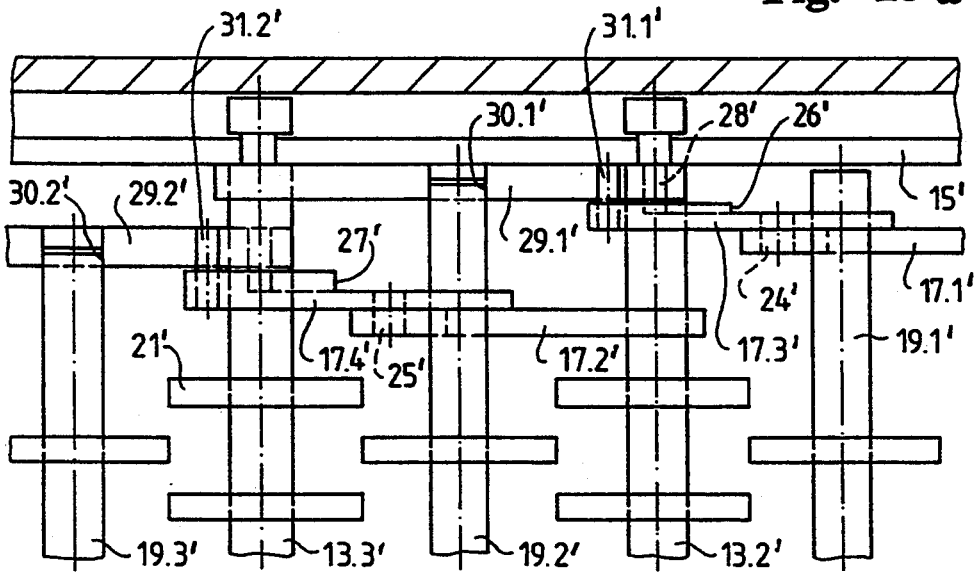
Figure 19:
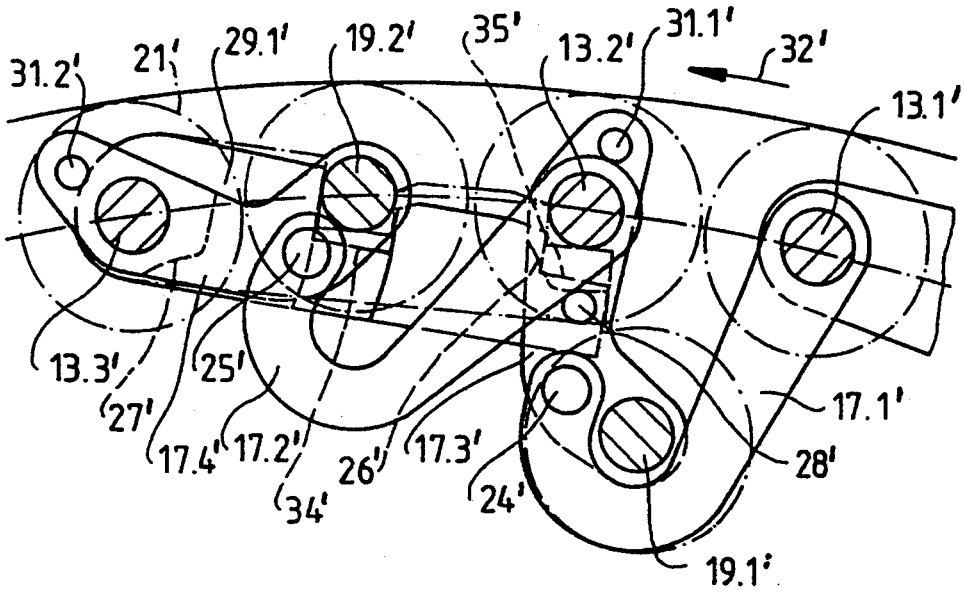
Figure 20:
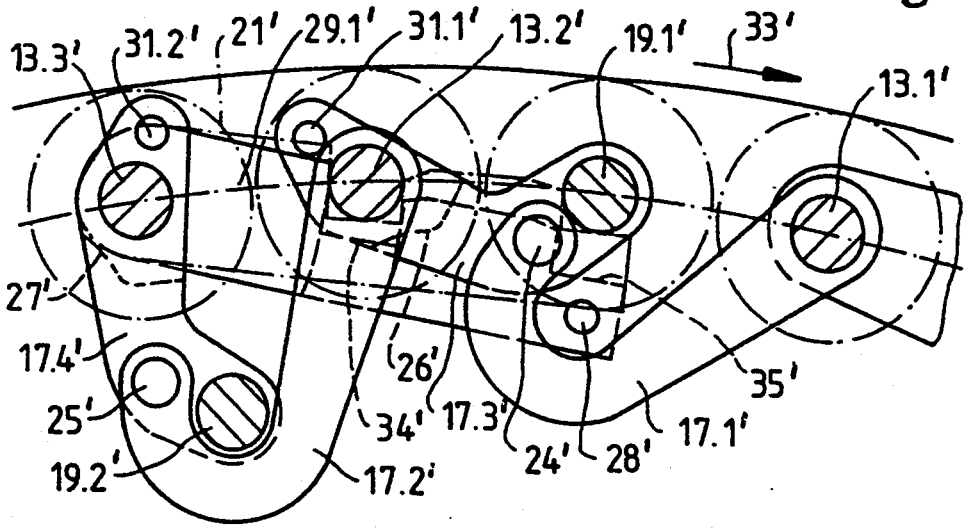

FIGS. 13 and 13*a* of another different embodiment of the device for guiding the sheet-holding elements;

FIG. 15 is a diagrammatic plan view of an interchangeable or reciprocal arrangement of bow-shaped sheet-holding elements;

FIG. 16 is a side elevational view of FIG. 15;

FIG. 17 is a diagrammatic end view of a sheet-transfer drum incorporating the device according to the invention;

FIG. 18 is an enlarged fragmentary view of FIG. 17 showing a setting for a maximum sheet size or format;

FIG. 18*a* is a top plan view of FIG. 18;

FIG. 19 is an instantaneous snapshot of FIG. 18 during a setting to a smaller sheet size or format; and FIG. 20 is an instantaneous snapshot of FIG. 18 during a setting to a larger sheet size or format.

Figure 1:
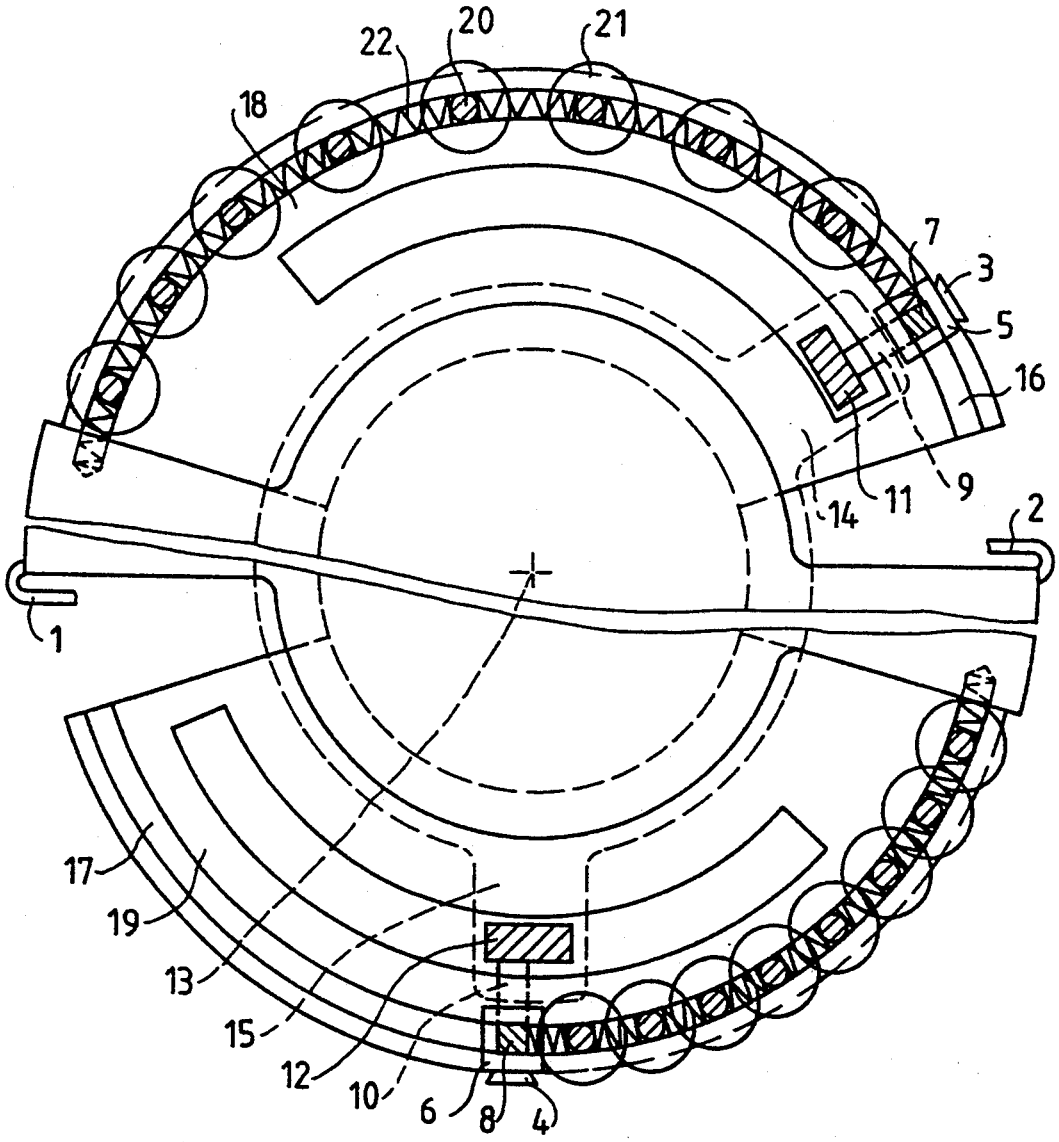
FIG. 1 is a diagrammatic Cross-sectional view of a sheet-transfer drum equipped with a device according to the invention.

Referring now to the drawings and, first, particularly to FIG. 1 thereof, there is shown therein a sheet-transfer drum which can be changed over from a maximum sheet size to a smaller sheet size, as is apparent in the lower half of FIG. 1. The sheet-transfer drum is capable of holding two sheets, the leading edges of the sheets being held in grippers 1, 2 and the trailing edges of the sheets being held by suction-type grippers 3, 4. The suction-type grippers 3, 4 are disposed on suction bodies 5, 6, which are displaceable on axially parallel guide rods 7, 8 for setting to the sheet width. The guide rods 7, 8 are connected to cross-members 11, 12 through the intermediary of spacer sleeves 9, 10. The cross-members 11, 12 connect bars or webs 14, 15 rotatably held on the shaft 13 on either side of the sheet-transfer drum. The guide rods 7, 8 run in circular guideways 16, 17 formed in discs 18, 19, disposed likewise on the shaft 13. Carrier rods 20 likewise run in the guideways 16, 17, with sheet-holding rollers 21, evenly distributed across the sheet-holding surface, being disposed on the carrier rods 20. Provided between the carrier rods 20 are springs 22 of basically identical spring stiffness. Consequently, the compression springs 22 keep the carrier rods 20 approximately evenly spaced as viewed in the circumferential direction.

In order to adjust to a smaller sheet size or format, as shown in the lower half of FIG. 1, the webs 14, 15 are rotated with respect to the fixed discs 18, 19. This results in a uniform compression of the compression springs 22. The sheet-holding rollers 21 telescope into one another in comb-like manner and serve, in any desired sheet size or format, for carrying the sheets. The cross-sectional surface area of such a sheet-transfer drum forms a polygon, the side surfaces of which are formed partially by the sheet-holding rollers 21. This results constantly in speed differences between the cylinders positioned up-line or down-line from the sheet-transfer drum.

In the embodiment shown in FIGS. 2 and 3, the sheet-holding elements 23 are of such construction that they form a closed surface with as few discontinuities as possible. The sheet-holding elements 23 themselves are provided laterally with bolts 24, which are displaceable in the guideway 16. The sheet-holding elements 23 are provided, in the rotation direction of the sheet-transfer drum, with corresponding pins 25 and grooves 26, so that the sheet-holding elements 23 are adapted to be slid into one another when adjusting to a smaller sheet size or format. This results in an outer cylindrical surface which is closed in the circumferential direction, such a surface ensuring a high quality, particularly in the case of perfectors.

A tilting of the sheet-holding elements 23 in the guideway 16 can be prevented by constructing the bolts 24 as shown in FIG. 4. The bolt 24 runs with guide surfaces 27, 28 in the guideway 16, 17. The compression springs 22 are supported on the contact surface 29, 30 of the bolt 24.

FIGS. 5 and 6 show the sheet-transfer drum according to FIGS. 2 and 3 after a change-over to a minimum sheet size or format. The compression springs 22 are compressed and the sheet-holding elements 23 are telescoped in a virtually closed manner with the pins 25 in the grooves 26.

FIGS. 7 to 11 illustrate embodiments of spring elements between the carrier rods 20 for the sheet-holding elements 23.

Figure 7:
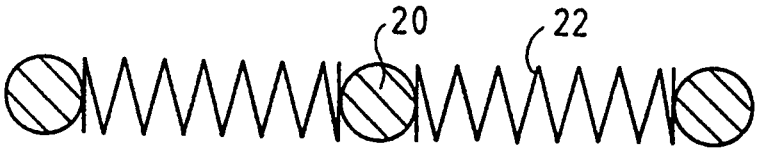
FIG. 7 is a diagrammatic longitudinal view of compression-spring elements forming part of the invention.
Figure 8:
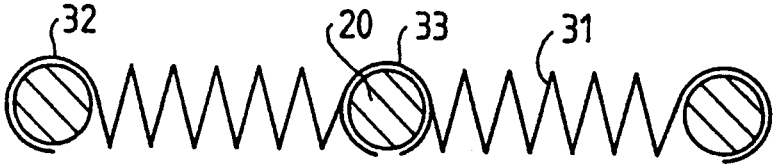
FIG. 8 is a diagrammatic longitudinal view of tension-spring elements forming part of the invention.
Figure 9:
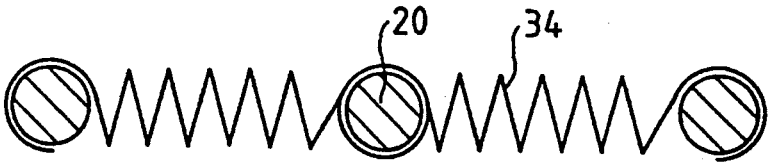
FIG. 9 is a diagrammatic longitudinal view of a single elongated tension spring.

FIG. 7 shows the hereinaforedescribed construction with individual compression springs 22. The different embodiment provided in FIG. 8 shows individual tension springs 31, which are connected in pairs to a carrier rod 20 by their hook-shaped ends 32, 33. The tension springs 31 may, as shown in FIG. 9, be replaced by one single tension spring 34.

Figure 10:
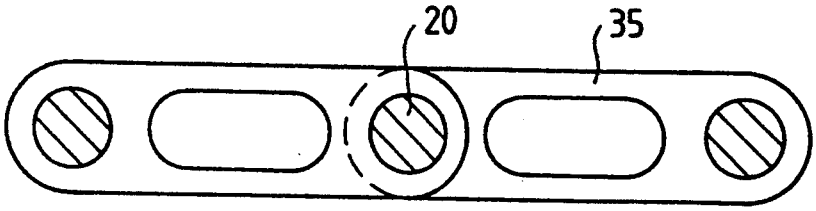
FIG. 10 is a longitudinal view of specially shaped rubber parts serving as spring elements.
Figure 11:
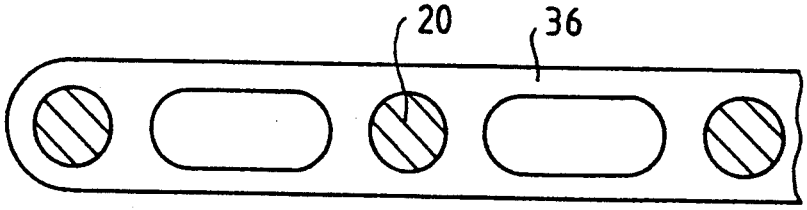
FIG. 11 is a longitudinal view of a rubber cord or strand serving as a spring element.
Figure 12:
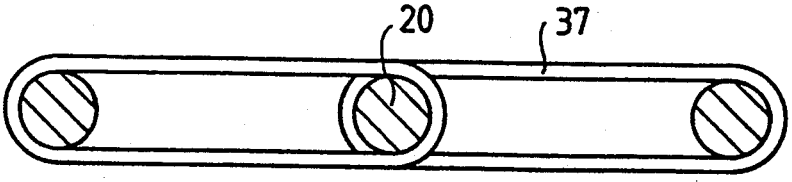
FIG. 12 is a longitudinal view of rubber rings serving as spring elements.

In FIG. 10, the spring elements are in the form of elastic specially-shaped rubber parts 35 which, as shown in FIG. 11, may likewise be replaced by one single rubber cord 36. A simple variant results from the use of individual rubber rings 37, which are obtainable as standard parts.

FIGS. 13, 13*a* and 14, 14*a* show differently constructed embodiments for guiding the sheet-holding elements 23. According to FIG. 13, the sheet-holding elements 23 are provided on the outside with guide lugs 38, by which they run in guideways 16, 17. The connection of the tension springs 31 or single tension spring 34 is effected at connecting pieces 39, which are situated under the sheet-holding elements 23 and are connected thereto.

The sheet-holding elements 23 shown in FIG. 14 project laterally beyond the discs 18 and 19, so that the sheet-transfer drum may be of compact construction and the ingress of dirt into the guideways is prevented.

The sheet-holding elements 23 may each be guided by means of two pins. The use of compression or tension springs is possible.

FIGS. 15 and 16 show sheet-holding elements 40 intermeshed in a chain-like manner, with two carrier rods 20 being situated in an oblong hole or slot 41. The sheet-holding elements 40 and the oblong holes or slots 41 are of bow-shaped construction. The sheet-holding elements 40 are slidable into one another within the range of motion of the oblong holes or slots 41.

The diagrammatic view according to FIG. 17 shows, in the upper half, a sheet-transfer drum in a setting to a maximum sheet size and, in the lower half, in a setting to a minimum sheet size. The sheet-transfer drum contains, on both sides, guide discs 2' on specially turned journals 1'. The guide discs 2' are rigidly interconnected by cross-members 3', 4'. Bolted onto the cross-members 3', 4' with the aid of spacers 5', 6' are square guides 7', 8', on which are axially displaceably disposed suckers 9', 10'. The suckers 9', 10' serve to hold the sheet trailing edges, while grippers 11', 12' are provided for holding the sheet leading edges. The square guides 7', 8' and the suckers 9', 10' are respectively connected to a first guide rod 13', 14' of a row of guide rods 13', 14', which run in guideways 15', 16' of the guide discs 2' on either side of the sheet-transfer drum. The guide rods 13', 14' are connected in pairs through the intermediary of straps 17', 18' to rods 19', 20', which are able to bend radially inwards, as is shown in the lower half of FIG. 1. Axially adjustable sheet-holding rollers 21' are seated on the guide rods 13', 14' and the rods 19', 20'. Adjustment from the maximum sheet size to the minimum sheet size is accomplished by means of adjusting discs 22', 23', which can be rotated on the journals 1' by means of a driving element (not shown). With the rotation of the adjusting discs 22', 23', the cross-members 3', 4' and the elements connected thereto are displaced in the circumferential direction.

In FIGS. 2 to 4, a hinged mechanism is provided between the guide rods 13', 14' and the rods 19', 20', the hinged mechanism not causing any change in the span of the sheet-holding rollers 21' when a setting is made to a new sheet size or format.

FIG. 2 Provides a detailed view with regard to the position of the sheet-holding elements 21' for a maximum sheet size or format. The straps 17.1' and 17.2' are of hook-shaped form, while the straps 17.3' and 17.4' are of bow-shaped form. The straps 17.1' and 17.2' are held on the guide rods 13.1' and 13.2', which run laterally in the guideway 15'. The straps 17.3' and 17.4' are held on the guide rods 13.2' and 13.3', with the rods 19.1' and 19.2' being held in the straps 17.3' and 17.4'. The other ends of the straps 17.1' and 17.2' are held on pins 24', 25', which are fastened to the straps 17.3' and 17.4'. The straps 17.3' and 17.4' each carry a curve-shaped shoulder 26', 27', which is contacted by a pin 28' of a radially outwardly spring-loaded bar 29.1'. The bars 29.1', 29.2' are each held on the guide rods 13', which run in the guideway 15'. The bars 29.1', 29.2' each have a groove 30.1' and 30.2' as a locking means for the rods 19.2', 19.3', so that only one of the rods 19.2' and 19.3' can be moved. Further Pins 31.1' and 31.2' are situated on the straps 17.3' and 17.4'. When the sheet size or format is enlarged, the pins 31.1' and 29.1' operate the bar 29.1', thus unlocking the rod 19.2'.

The arrangement of the straps 17' and 18', of the bars 29' and of the pins 24', 25', 28', 31' is repeated for each sheet-holding surface according to the number of guide rods 13', 14'.

FIG. 3 shows the sequence of motions for setting to a smaller sheet size or format. When the guide rod 13.1 is moved in the direction of the arrow 32', the straps 17.1' and 17.3' are rotated about the axis of the pin 24', the rod 19.1' being moved radially inwards. Due to the rotation of the straps 17.3', the pin 28' comes into contact with the curve-shaped shoulder 26'. A further rotation of the strap 17.3' swivels the bar 29.1' downwardly about the axis of the guide rod 13.3', so that the guide rod 13.2' is able to slide over the bar 29.1' and the rod 19.1' is moved radially inwards. In the end position, the bar 29.1' is moved upwardly by means of a spring (not shown), so that the guide rod 13.2' is locked in a cutout of the bar 29.1'.

The sequence for the inward motion of the guide rods 19' is repeated step by step for each further rod 19'.

During sheet-size or format enlargement as shown in FIG. 4, the guide rod 13.2' is moved in the direction of the arrow 33', so that the straps 17.1' and 17.3' rotate on the guide rods 13.1' and 13.2'. During this rotation, the pin 31.1' comes into contact with the top edge of the bar 29.1'. For further adjustment of the sheet size or format, the pin 31.1' presses the bar 29.1' downwards against the spring force and the rod 19.1' comes into the cutout disposed at the end of the bar 29.1'. The rod 19.1' assumes such a position that the sheet-holding rollers 29' are in the sheet-holding plane. The bars 29' secure the positions of the guide rods 13' and of the rods 19' in the circumferential direction.

We claim:

1. Device for sheet-format adjustment of a sheet-transfer drum, formed of sheet-holding elements displaceable in guides in a rotational direction of the sheet-transfer drum and having at least two gripper devices for holding sheet leading and trailing edges, the gripper devices being adjustable relative to one another in an outer cylindrical surface of the sheet-transfer drum in the rotational direction thereof, the sheet-holding elements and the gripper devices being simultaneously adjustable for sheets to be transported on the sheet-transfer drum, comprising resilient elements connected to adjacent sheet-holding elements on both sides of the sheet-transfer drum, said resilient elements having substantially identical spring constants.

2. Device according to claim 1, wherein said resilient elements are tension springs.

3. Device according to claim 1, wherein said resilient elements are compression springs.

4. Device according to claim 1, wherein said resilient elements are shaped rubber elements.

5. Device according to claim 1, wherein said resilient elements are rubber cords, and the guides for the sheet-holding elements are embedded in said rubber cords.

6. Device according to claim 1, wherein said resilient elements are rubber rings, respectively, looping around two adjacent guides of the sheet-holding elements.

7. Device for sheet-format adjustment of a sheet-transfer drum, including sheet-holding elements displaceable in guides radially and in a rotational direction of the sheet-transfer drum, gripper devices for holding sheet leading and trailing edges, the gripper devices being adjustable in an outer cylindrical surface of the sheet-transfer drum in a rotational direction thereof, the sheet-holding elements and the gripper devices being simultaneously adjustable for sheets to be transported, comprising orbital guideways disposed laterally of the sheet-transfer drum, guide rods running in said orbital guideways, other rods disposed between said guide rods and being radially displaceable, all of said guide rods adjacent one another and said other rods being rigidly connected to one another, and the sheet-holding elements being disposed on said guide rods and said other rods.

8. Device according to claim 7, including a plurality of bars mounted on said guide rods and cooperatively engaging at least two mutually adjacent ones of said guide rods and said other rods extending in one direction, coupling elements extending between said guide rods and said other rods, and pins disposed in said guide rods and in said coupling elements for rigidly connecting said guide rods and said other rods.

* * * * *